US011404778B2

(12) United States Patent
Mertel

(10) Patent No.: US 11,404,778 B2
(45) Date of Patent: Aug. 2, 2022

(54) PHASED-ARRAY ANTENNA SYSTEM HAVING VARIABLE PHASING AND RESONANCE CONTROL

(71) Applicant: SteppIR Communication Systems Inc., Bellevue, WA (US)

(72) Inventor: Michael E Mertel, Bellevue, WA (US)

(73) Assignee: Steppir Communication Systems, Inc., Bellevue, WA (US)

( * ) Notice: Subject to any disclaimer, the term of this patent is extended or adjusted under 35 U.S.C. 154(b) by 640 days.

(21) Appl. No.: 16/398,095

(22) Filed: Apr. 29, 2019

(65) Prior Publication Data

US 2020/0343630 A1 Oct. 29, 2020

(51) Int. Cl.

*H01Q 3/26* (2006.01)
*H01Q 25/00* (2006.01)
*H01Q 3/01* (2006.01)

(52) U.S. Cl.

CPC ..... *H01Q 3/267* (2013.01); *H01Q 3/01* (2013.01); *H01Q 3/2682* (2013.01); *H01Q 25/002* (2013.01)

(58) Field of Classification Search

CPC ..... H01Q 3/267; H01Q 3/01; H01Q 25/002
See application file for complete search history.

(56) References Cited

U.S. PATENT DOCUMENTS 6,507,315 B2 * 1/2003 Purdy ..... H01Q 25/00 342/174
RE42,087 E * 2/2011 Mertel ..... H01Q 19/30 343/815
2016/0315385 A1 * 10/2016 Grass ..... H01Q 3/36
2019/0267707 A1 * 8/2019 Khalil ..... H01Q 3/38

FOREIGN PATENT DOCUMENTS

CN 109301480 B * 3/2021 ..... H01Q 1/2258
JP 07288417 A * 10/1995
JP 2017011549 A * 1/2017

OTHER PUBLICATIONS

Smart, G. [George Smart] (Aug. 9, 2014). Variable Capacitor—Stepper motor [Video], YouTube, https://www.youtube.com/watch?v=ZHSVYjKsXjQ (Accessed Dec. 21, 2021).*

* cited by examiner

*Primary Examiner* — Ab Salam Alkassim, Jr.
*Assistant Examiner* — Anh N Ho
(74) *Attorney, Agent, or Firm* — Kenneth D'Alessandro

(57) ABSTRACT

A phased antenna array includes a plurality of variable length radiators arrayed in a geometric pattern. A length control mechanism is mechanically coupled to each one of the variable length radiators and responsive to radiator length control data to control the length of the variable length radiator. A variable phase delay circuit is coupled to each of the variable length radiators and responsive to phase delay control data to control a phase delay of a radio frequency signal coupled to the variable phase delay circuit. A controller has phase delay circuit control outputs coupled to each one of the variable phase delay circuits, and length control circuit coupled to each one of the length control mechanisms. The controller is configured to send radiator length control data to each one of the length control mechanisms and to send phase delay data to each one of the variable phase delay circuits.

21 Claims, 7 Drawing Sheets

In a four-square example the feedline can be daisy chained from unequal (e.g., imprecisely cut) length feedline sections instead of requiring 4 precision cut equal-length sections from a control box

PHASED-ARRAY ANTENNA SYSTEM HAVING VARIABLE PHASING AND RESONANCE CONTROL

The present invention relates to radio frequency (RF) systems. More particularly, the present invention relates to phased array antenna systems and to phased array antenna systems having variable phasing and resonance control.

BACKGROUND

Use of phasing techniques to steer the beam of two or more antennas is well documented in the RF environment. Phasing was first introduced in 1905 by Karl Ferdinand Braun using three vertical radiators that were driven together, with a quarter wave delay in the feedline of one of the antennas. This caused the array to radiate a beam of increased intensity in a particular direction by redistributing the available RF power. The delay could be switched manually into any of the three feedlines, enabling the antenna beam to be rotated by 120 degrees.

Phasing antennas together successfully is not without its challenges. Getting the desired pattern from a phased array requires that each radiating element has the same current flowing in it and the phase delays are correct. Obtaining the correct phase delays along with equal current to each radiating element can be exceedingly difficult, primarily because there are so many variables. This is especially true in the high-frequency (HF) frequency range (3 MHz-30 MHz) because the radiators are so large that they can be greatly affected by their environment. At much higher frequencies ranging into the Gigahertz range the radiating elements can easily be fabricated on a printed circuit board, allowing precise control over antenna impedances and external environment, etc.

It was many years before engineers realized that the phased arrays in the HF range were often not performing anywhere near the calculated values. This was due to non-symmetry in the radiators, ground effects, velocity factor variations in feedlines, non-symmetry of radial fields on vertical arrays, mismatches in the delay lines, insulators, interactions with support structures on horizontal antennas, and many more unexpected phenomena. Phased arrays have long been built using different lengths of feedlines that are multiples of ¼ wavelength to get the desired phase shifts of 90 degrees, 180 degrees, etc. This method turns out to be flawed because it assumes that the transmission lines are terminated in their characteristic impedance. The problem is that current phase shift through a transmission line is dependent on its load impedance. Additionally the feed-point "operating" impedances of elements in a phased array are not equal to each other, nor are they equal to their individual or "self" impedances. This is caused by the electro-magnetic coupling between the elements. They are close enough physically that they influence each other very significantly. As a result, every time the length of one transmission line is changed the impedance mismatches on all lines change, the relative element currents change, etc. In fact, just about everything interacts in a multi-element antenna.

A solution to this is using both a variable phase delay and an adjustable radiator length to allow changing of the individual element impedances to get the desired phase delays and current equalization.

Some Software Defined Radios are available that can output two identical signals with one time delayed with respect to the other. However, they lack the ability to measure the result and calibrate the system to give repeatable results and would require the use of multiple feedlines. Additionally classic phasing systems are very narrow in bandwidth relegating the user to essentially a 0.5% or less frequency range.

One problem that has been encountered in the design of phased antenna systems is knowing when the desired phase difference has been achieved. Variable phasing has been used in the past by having a human operator vary the phase to one or more antennas in the array while listening to the received signal or measuring the signal strength using a spectrum analyzer (or receiver strength meter) until the desired pattern is achieved. One solution that has been proposed is set forth in U.S. Pat. No. 6,507,315 to Purdy et al.

BRIEF DESCRIPTION

The current invention relates to improving the performance of HF phased arrays of all types. What is proposed is a variable phase delay and matching system that can mitigate all of the variables that can degrade the performance of a phased array.

By making the phasing system variable and adjusting individual radiating elements a very wide range of frequencies can be covered, 2:1 easily without moving the physical positions of the radiators. The present invention combines the adjustable phasing with the ability to dynamically change the radiator length of each radiator of the phased array. The ability to switch into the array additional antenna elements located at different spacings allows coverage of very wide frequency ranges, as much as a 10:1 range is then possible.

The phased array antenna system of the present invention allows any radio to be used with a remotely controlled phased array, eliminating the need to run multiple feedlines out to the array.

The radiator may be length adjusted to select resonant frequency and to also tune out any reactance in the phased radiators.

BRIEF DESCRIPTION OF THE DRAWING FIGURES

The invention will be explained in more detail in the following with reference to embodiments and to the drawing in which are shown:

DETAILED DESCRIPTION

Persons of ordinary skill in the art will realize that the following description is illustrative only and not in any way limiting. Other embodiments will readily suggest themselves to such skilled persons.

Figure 1A:
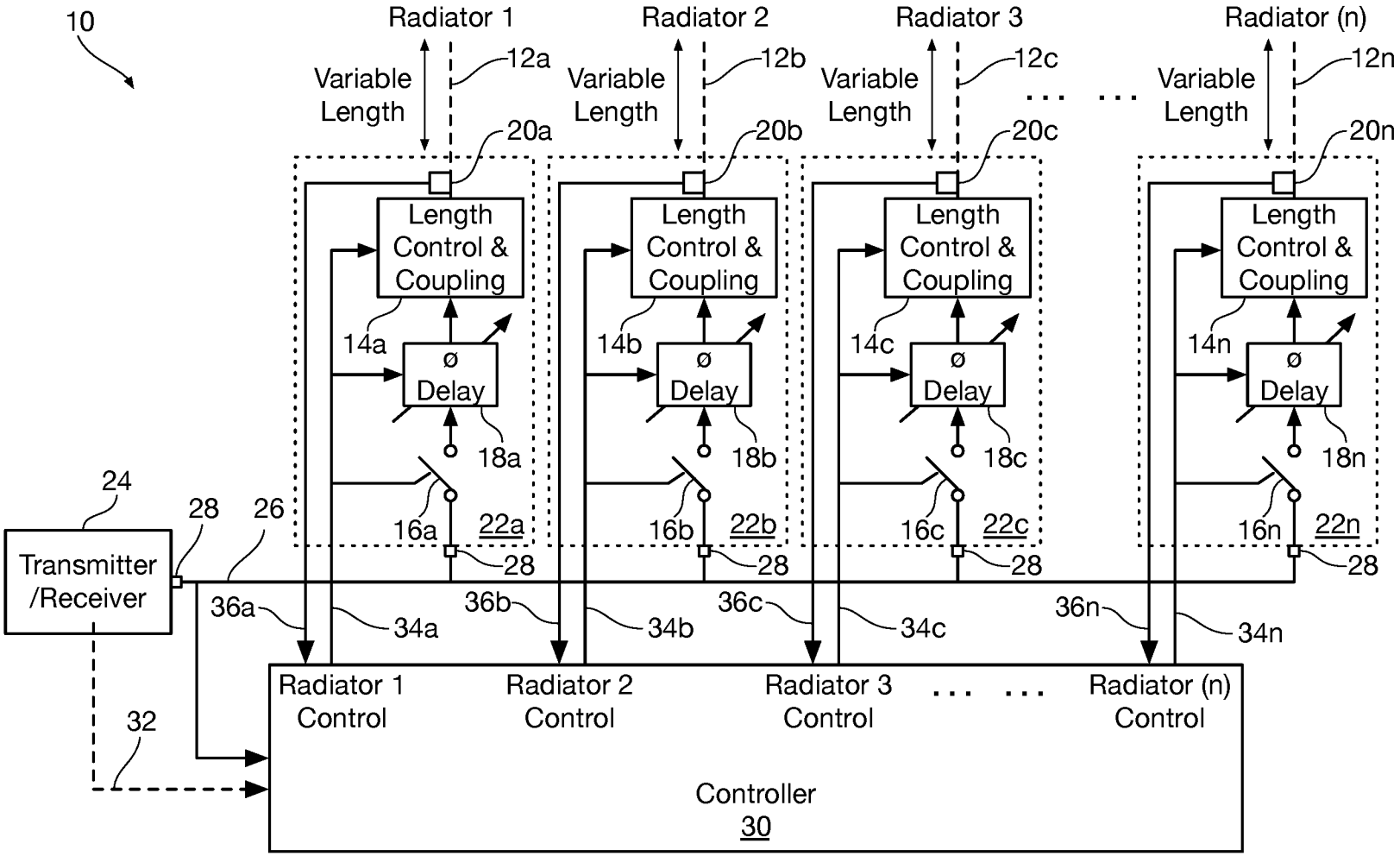
FIG. 1A is a block diagram of a phased-array antenna system showing a plurality of antenna radiators and having variable phasing and resonance control in accordance with an aspect of the present invention.

Referring first of all to FIG. 1A, a block diagram shows an illustrative phased-array antenna system 10 having a plurality of antenna radiators and having variable phasing and resonance control in accordance with an aspect of the present invention. The system 10 is shown having n radiators 12*a* through 12*n*. Persons skilled in the art will appreciate that n can be an integer greater than 2 The upper limit of n will depend on practical considerations for any given system.

Each of radiators 12*a* through 12*n* is length variable. Varying the lengths of individual antenna radiators is known in the art. See, for example, U.S. Pat. No. RE42087 to Mertel for a particular electromechanical arrangement for varying the length of an antenna radiator element using stepper motors driving perforated metal tape. The present invention contemplates the use of any arrangement for varying the length of an antenna radiator element. Length control and coupling units 14*a* through 14*n* are shown mechanically coupled to their respective length-variable radiators 12*a* through 12*n*.

Switches 16*a* through 16*n* are shown electrically coupled to their respective length control and coupling units 14*a* through 14*n* through variable phase units 18*a* through 18*n* respectively. The switches 16*a* through 16*n* may be formed using known RF switching techniques and components and enable selective coupling or decoupling of each of the length-variable radiators 12*a* through 12*n* and the variable phase units 18*a* through 18*n* allow controlling the relative phase of radio frequency (RF) energy used to drive each of the length-variable radiators 12*a* through 12*n*. Configuring variable phase delay units is well known in the art. Examples include single-pole resistor/inductor circuits, single-pole resistor/capacitor circuits, capacitor/inductor circuits arranged as Pi networks or L networks, low-pass and high-pass networks, switched lines, active component shifters, etc. All that is needed to achieve variable delays are adjustable components or electronically switched lumped value components.

Phase and current sensors 20*a* through 20*n* are individually coupled to their variable-length radiators 12*a* through 12*n*. Phase and current sensors 20*a* through 20*n* are coupled to their variable-length radiators 12*a* through 12*n* and sense the phase of the RF energy applied to their variable-length radiators 12*a* through 12*n*. Examples of phase and current sensors that may be used with the present invention include various types of inductive RF pickup probes and RF current probes using single turn or more toroidal core transformers.

In one instance of the invention, each of the length control and coupling units 14*a* through 14*n*, switches 16*a* through 16*n*, the variable phase units 18*a* through 18*n*, and the phase and current sensors 20*a* through 20*n* may be housed together in suitable enclosures, identified by reference numerals 22*a* through 22*n* shown as dashed lines in FIG. 1. Examples of such enclosures used with variable-length antenna elements are found in products manufactured by Steppir Communication Systems, Inc. of Bellevue, Wash.

A transmitter, transceiver, or receiver 24 is coupled to the switches 16*a* through 16*n* in each of the enclosures 22*a* through 22*n* using non-critical lengths of transmission line 26. RF connectors 28 are used to connect the transmission line to the various system components as is known in the art.

The transmitter, transceiver, or receiver 24 is also coupled to a controller 30, either through the transmission line 26 or through a control cable shown in dashed lines at reference numeral 32. Controllers for antennas having variable-length radiating elements are known in the art and representative examples are found in controllers manufactured by Intentional Systems, Inc., of Bellevue, Wash. These controllers have been used to control the lengths of individual variable-length radiators 12*a* through 12*n* as well as to connect individual ones of variable-length radiators 12*a* through 12*n* as driven elements or to disconnect individual ones of variable-length radiators 12*a* through 12*n* for use as passive elements in an antenna system. Control signals are passed from the controller 30 to the length control and coupling units 14*a* through 14*n*, switches 16*a* through 16*n*, the variable phase units 18*a* through 18*n*, by control cables shown at reference numerals 34*a* through 34*n*. Output signals are passed from the phase and current sensors 20*a* through 20*n* by control cables shown at reference numerals 36*a* through 36*n*. Persons skilled in the art will appreciate that wireless communication between the controller 30 and the length control and coupling units 14*a* through 14*n*, switches 16*a* through 16*n*, the variable phase units 18*a* through 18*n*, and the phase and current sensors 20*a* through 20*n* is possible. See, for example, wireless products available from Green Heron Engineering of Webster, N.Y.

The variable phase units 18*a* through 18*n* allow the antenna array 10 to be "steered" to provide different azimuthal gain patterns. In addition, the switches 16*a* through 16*n* allow antenna arrays to be configured having different basic azimuthal gain patterns. The controller 30 uses input signals from the phase and current sensors 20*a* through 20*n* to determine the actual relative phase of the RF signals applied to the individual variable-length radiators 12*a* through 12*n*, allowing the controller to individually change the relative phase of the RF signals applied to the individual variable-length radiators 12*a* through 12*n* to "steer" the gain pattern of the phased array. This feature of the present invention overcomes the limitations of the prior-art systems by allowing use of the phased array over a relatively wide frequency range while maintaining high performance.

Figure 1B:
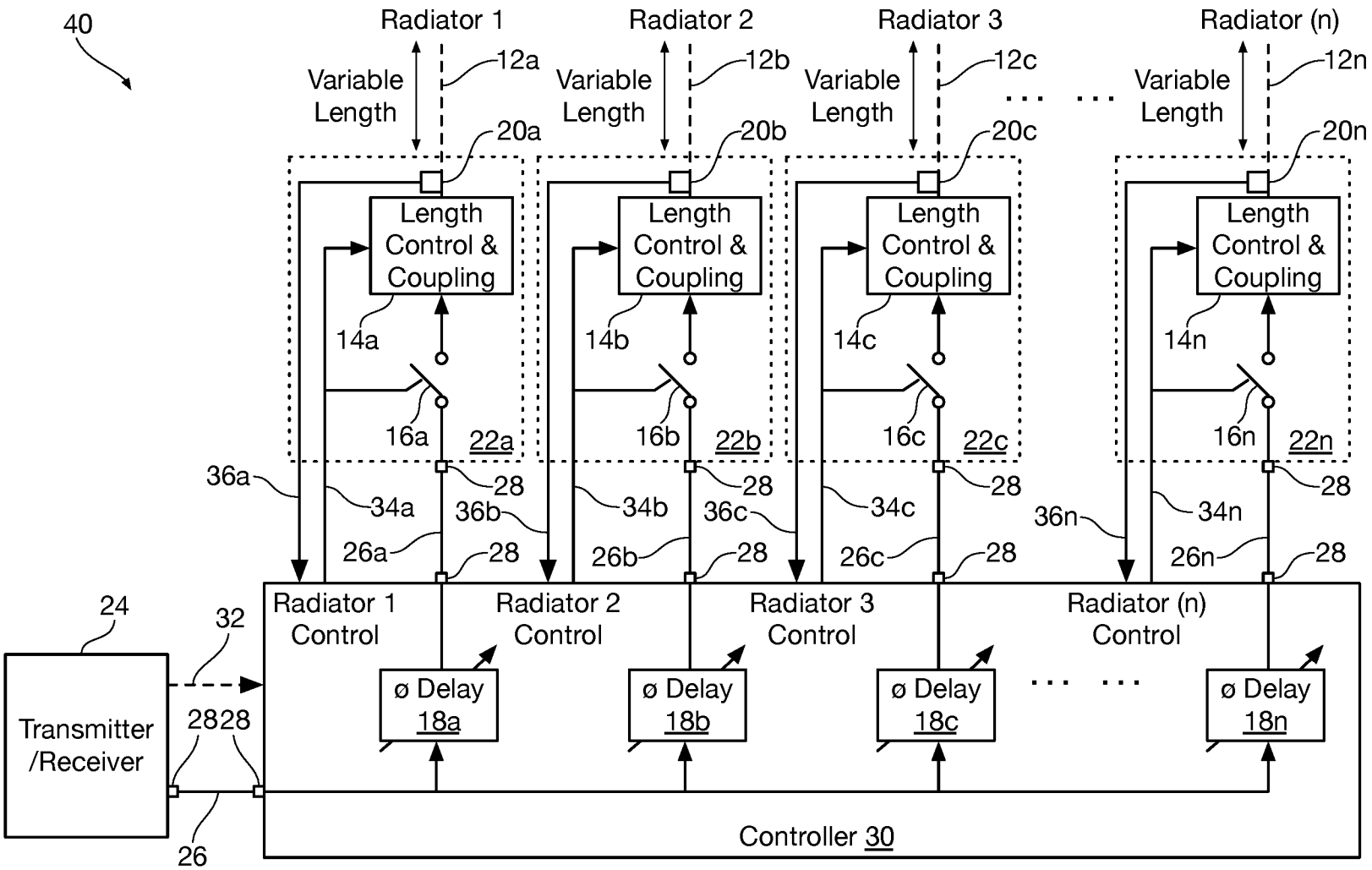
FIG. 1B is a block diagram of another phased-array antenna system having a plurality of antenna radiators and having variable phasing and resonance control in accordance with an aspect of the present invention.

Referring now to FIG. 1B, a block diagram illustrates another phased-array antenna system 40 having a plurality of antenna radiators and having variable phasing and resonance control in accordance with an aspect of the present invention. The phased array system 40 is substantially similar to the phased array antenna system 10 of FIG. 1A and the system elements will be identified using the same reference numeral used to designate those system elements in FIG. 1A.

The main difference between the phased-array antenna system 10 of FIG. 1A and the phased-array antenna system 40 of FIG. 1B is that the variable phase units 18*a* through 18*n* are housed within the controller 30 rather than in the housing units 22*a* through 22*n* located at the radiators 12*a* through 12*n*. Individual lengths of transmission lines 26*a* through 26*n* are used to couple the RF output power from the phase delay units 18*a* through 18*n*, respectively, via RF connector 28 in the controller 30 to the switches 16*a* through 16*n*, respectively, via RF connector 28 in the housing units 22*a* through 22*n*.

Figure 2:
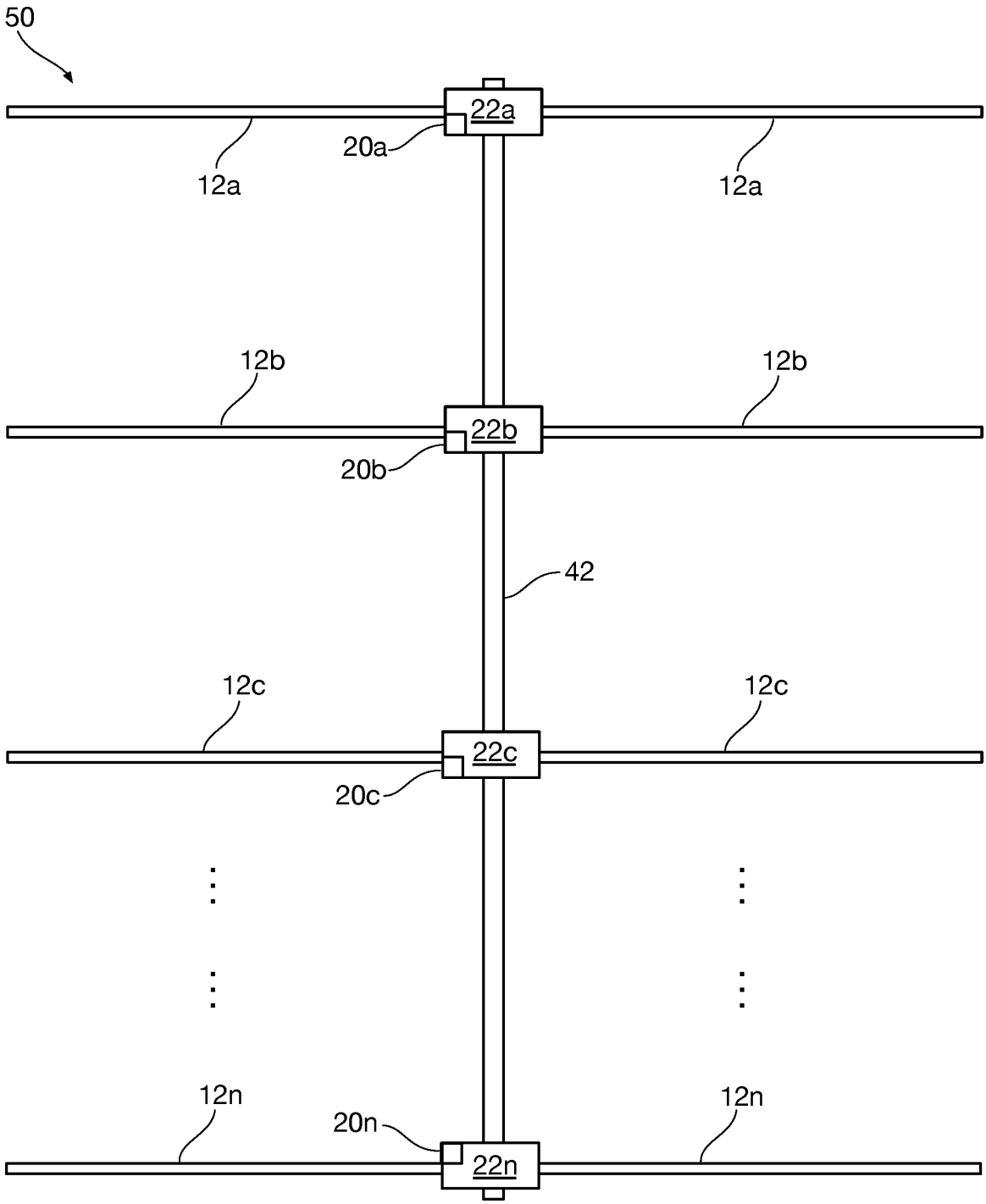
FIG. 2 is a diagram showing a Yagi type antenna and having variable phasing and resonance control in accordance with an aspect of the present invention.

Referring now to FIG. 2, a diagram shows another configuration of an antenna system in accordance with an aspect of the present invention in the form of a representative Yagi type antenna 50 having variable phasing and resonance control in accordance with an aspect of the present invention. Certain elements of the antenna system 50 of FIG. 2 are common to elements shown in the antenna system 10 of FIG. 1A and will be identified in FIG. 2 using the same reference numerals used to identify corresponding elements in FIG. 1A.

The Yagi antenna 50 is shown in FIG. 2 having n elements including representative elements 12*a*, 12*b*, 12*c*, and 12*n* mounted on a boom 42. In one instance of the invention, each of the length control and coupling units 14*a* through 14*n*, switches 16*a* through 16*n*, the variable phase units 18*a* through 18*n* (none of which are explicitly shown in FIG. 2), and the phase and current sensors 20*a* through 20*n* may be housed together in suitable enclosures, identified by reference numerals 22*a* through 22*n* in FIG. 2.

Persons of ordinary skill in the art will appreciate that the positions of the elements on the boom are fixed. In accordance with the present invention, any one or more elements can be completely retracted to selectively remove them from the array, or can be driven or left passive depending on the states of the switches 16*a* through 16*n* and the relative phase of any RF energy driving the driven elements can be controlled by controlling variable phase units 18*a* through 18*n* using feedback obtained from the phase and current sensors 20*a* through 20*n*. In an alternate configuration, the phase and current sensors 20*a* through 20*n* can be located in the controller 30 as shown in FIG. 1B instead of at the antenna itself.

Figure 3:
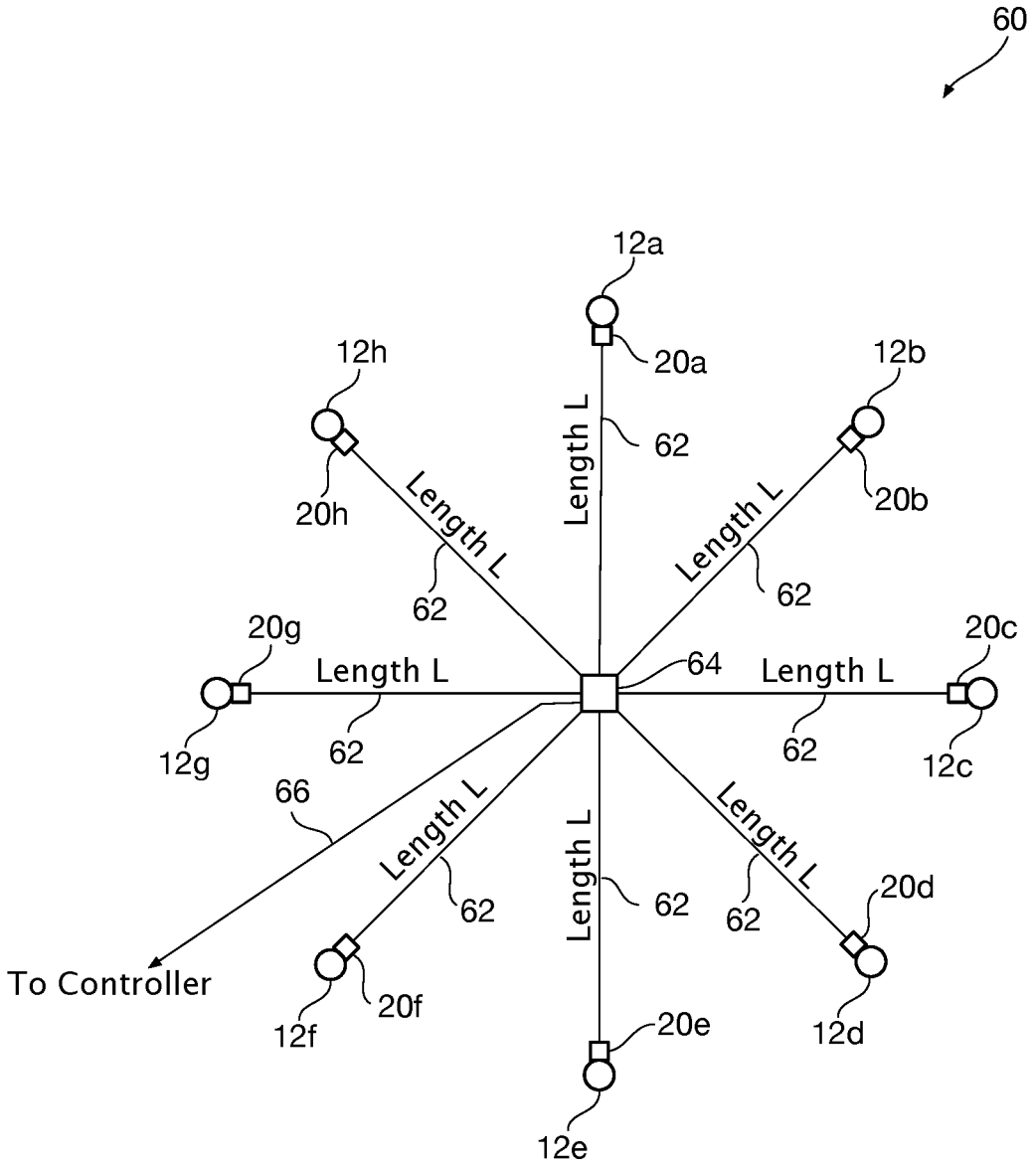
FIG. 3 is a diagram showing a daisy-chained feed line having random segment lengths for driving an antenna system having variable phasing and resonance control in accordance with an aspect of the present invention.

Referring now to FIG. 3, a diagram shows an illustrative configuration for measuring the relative phases of RF energy on the radiators in a phased antenna array in accordance with the present invention. The particular configuration shown in FIG. 3 is for a phased antenna array 60 where the number of radiators (n) is equal to eight. Persons of ordinary skill in the art will appreciate that the particular configuration shown in FIG. 3 is illustrative only and that n may be equal to at least two radiators.

Thus, radiators 12*a* through 12*h* are shown in the phased array of FIG. 3. A phase and current sensor (20*a* through 20*h*) is associated with each radiator and is closely spaced from the radiator in order to efficiently sense the current and phase of the RF energy in its associated radiator.

An equal length "L" of transmission line or cable, e.g., twisted pair cable, identified at reference numerals 62 are coupled between each phase and current sensor 20*a* through 20*h* and a phase and current calculating circuit 64 that takes the signals from the phase and current sensors 20*a* through 20*h* and outputs signals representing the current and relative phase information for the RF energy fed to radiators 12*a* through 12*h*. The fixed length transmission lines 62, could also be replaced with a wireless system as long as the receiver is centrally located to ensure the time delays are equal. Alternatively the delays can be calculated and calibrated out. The RF power transmission lines to each radiator are not shown for clarity. A cable 66 conveys the output signals to the controller 30 of FIG. 1A or 1B.

Figure 4:
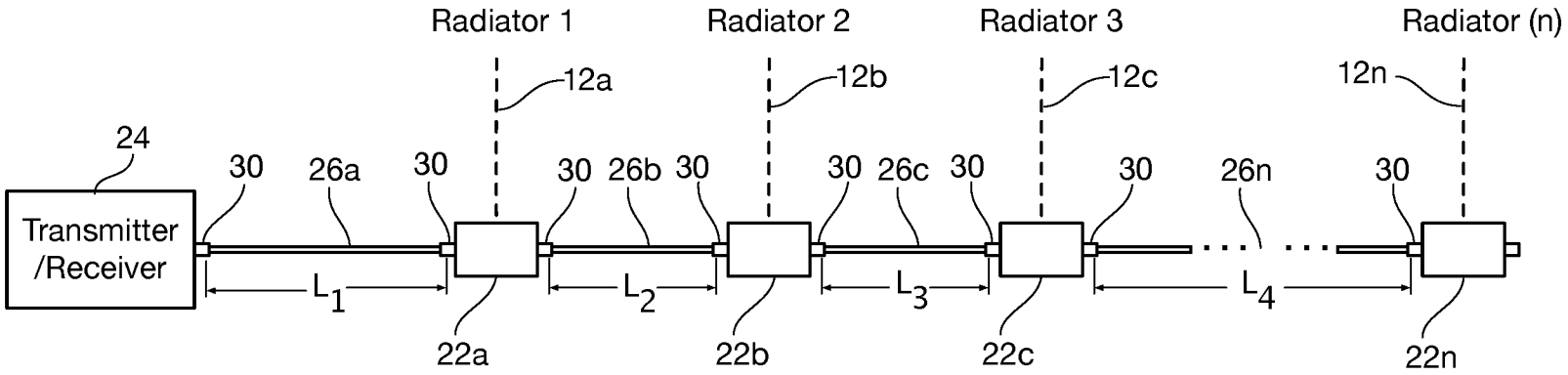
FIG. 4, is a diagram showing an illustrative daisy-chained feed line having random segment lengths for driving an antenna system having variable phasing and resonance control in accordance with an aspect of the present invention.

Referring now to FIG. 4, a diagram shows an illustrative daisy-chained feed line having random segment lengths for driving an antenna system having variable phasing and resonance control in accordance with an aspect of the present invention. The feedline extends from transmitter, transceiver, or receiver 24 and in an embodiment where n=4 includes a first segment 26*a* having length L1 connected between the transmitter, transceiver, or receiver 24 and the enclosure 22*a*, a second segment 26*b* having length L2 connected between the enclosure 22*a* and the enclosure 22*b*, a third segment 26*c* having length L3 connected between the enclosure 22*b* and the enclosure 22*c*, and a fourth segment 26*n* having length L4 connected between the enclosure 22*c* and the enclosure 22*n*. Suitable mating RF connectors shown symbolically at reference numeral 28 are used to couple the ends of the feedline segments 26*a*, 26*b*, 26*c*, and 26*n* to the enclosures 22*a*, 22*b*, 22*c*, and 22*n* as is well known in the art.

As will be appreciated by persons of ordinary skill in the art the feedline segments 22*a*, 22*b*, 22*c*, and 22*n* have random lengths L1, L2, L3, and L4. This aspect of the invention is made possible by the use of the variable phase units 18*a* through 18*n* and is advantageous in that it eliminates the need for carefully providing feedline segments cut to predetermined fixed lengths in phased arrays in accordance with the present invention and allows the feedline segments to be daisy chained rather than fed to the individual radiators through quadrature hybrid combiner or other device that "forces" the current to be the correct magnitude as is required in the prior art.

Figure 5:
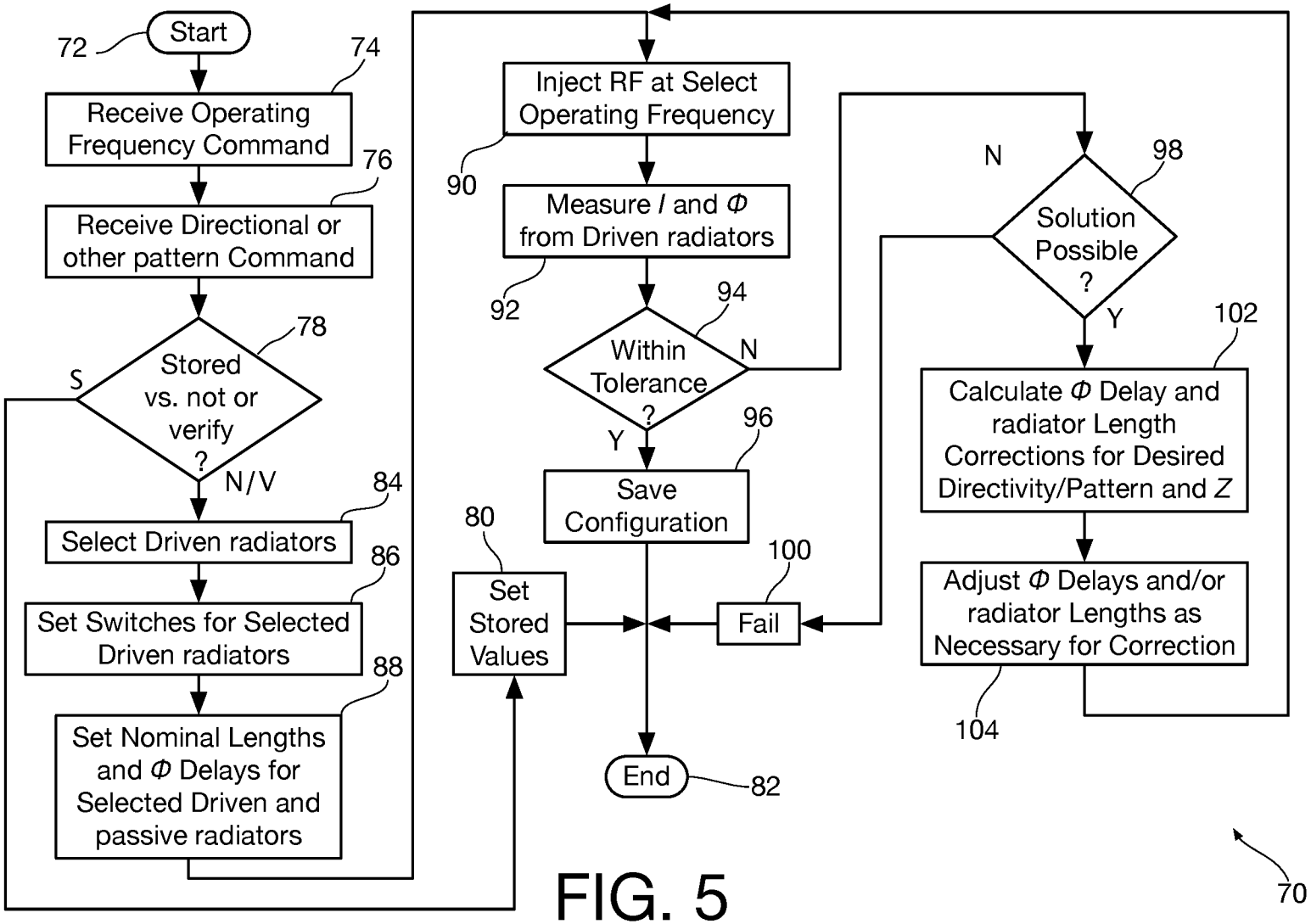
FIG. 5 is a flow diagram showing an illustrative method for controlling a phased-array antenna system having a plurality of antenna radiators and having variable phasing and resonance control in accordance with an aspect of the present invention.

Referring now to FIG. 5, a flow diagram shows an illustrative method 70 for controlling a phased-array antenna system having a plurality of antenna radiators and having variable phasing and resonance control in accordance with an aspect of the present invention. The method is implemented inside the controller 30 or may be implemented in a general purpose computer running appropriate control software. The method begins at reference numeral 72.

At reference numeral 74 a command specifying an operating frequency is received by the controller 30. This command may be generated in response to direct user input to the controller or received from the transmitter, transceiver, or receiver 24 either by being sensed on the feedline in the case of a transmitted signal, or being a command sent from the transmitter, transceiver, or receiver 24 using a suitable communications protocol over a control interface on lines 32 (shown in FIG. 1A and FIG. 1B) connected between the transmitter, transceiver, or receiver 24 and the controller 30 as is known in the art.

At reference numeral 76 a directional or other azimuthal pattern command is received by the controller 30 indicating a desired directional or other azimuthal radiation pattern for the phased array being controlled. In accordance with the present invention, antenna modeling may be performed to generate the information necessary for configuring the phased array 10 to achieve desired directional or other azimuthal radiation pattern (as well as other parameters such as directional gain). The modeling may be performed on the fly using selected available antenna modeling software and/or preselected directional or other azimuthal radiation pattern information may be stored in memory resident in or accessible by the controller.

At reference numeral 78 it is determined whether data defining the phased antenna array configuration defined by the information received at reference numerals 74 and 76 has previously been stored in the system and further whether there is a user request to verify that the stored data will implement a phased array that is within tolerance. If data defining the antenna array configuration defined by the information received at reference numerals 74 and 76 has previously been stored in the system and there has been no user request to verify that the stored data will implement a phased array that is within tolerance, the method proceeds to reference numeral 80 where the stored values needed to implement the phased antenna array configuration defined by the information received at reference numerals 74 and 76, the controller sends to the phased antenna array the commands necessary to configure the radiator lengths, relative phases, and define which ones of the radiators will be driven. The method then ends at reference numeral 82.

If data defining the antenna array configuration defined by the information received at reference numerals 74 and 76 has not been previously stored in the system or there has been a user request to verify that the stored data will implement a phased array that is within tolerance, the method proceeds to reference numeral 84, where the ones of radiators 12*a* through 12*n* to be driven are selected. In some systems, and configurations this may be unnecessary where all of the radiators are to be driven.

At reference numeral 86 the states of the switches through 16*n* are set to drive the selected ones of radiators 12*a* through 12*n* switches. At reference numeral 88 the nominal lengths for the selected driven radiators as well as any passive radiators to be included in the array are set. Ones of radiators 12*a* through 12*n* that are not to be used in the design may be completely retracted or set to lengths that exhibit high impedance at the selected operating frequency. At reference numeral 88, nominal phase delays are also set for the selected driven radiators to achieve the desired directivity or other azimuthal pattern.

Persons of ordinary skill in the art will appreciate that the commands that are sent from the controller 30 to the length control and coupling units 14*a* through 14*n*, switches 16*a* through 16*n*, the variable phase units 18*a* through 18*n* can be sent while performing the individual procedures set forth at reference numerals 84, 86, and 88 or may be sent after all of the individual procedures set forth at reference numerals 84, 86, and 88 have been completed. In addition, the order in which the procedures set forth at reference numerals 84, 86, and 88 is not important to operation of the method of the present invention.

After the controller has sent the commands necessary to configure the radiator lengths, relative phases, and define which ones of the radiators will be driven and the commands have been executed, as shown at reference numeral 90, RF energy is injected into the phased array at the selected operating frequency. This may be done by the transmitter or transceiver 24 under the direction of the controller or, in some embodiments, an RF generator in the controller may be activated to inject RF energy into the phased array at the selected operating frequency.

At reference numeral 92 current and phase of the RF signal injected into the driven radiators are measured by the ones of phase and current sensors 20*a* through 20*n* associated with driven radiators. At reference numeral 94, it is determined whether the measured phase, current, and impedance are within acceptable tolerance. The concept of acceptable tolerance will vary for individual systems and preselected empirically determined quantities may be used to make these determinations.

If it is decided at reference numeral 94 that the performance of the phased array is within acceptable tolerance limits the configuration defined by the current radiator lengths, switch settings, and phase (GP) delays are saved at reference numeral 96, and the method ends at reference numeral 82. If it is decided that the performance of the phased array is not within acceptable tolerance limits the method proceeds to reference numeral 98 where it is determined whether an acceptable solution is possible. This may involve an evaluation of the phase control and length control possibilities or may be based on a predetermined number of prior failed attempts through the procedures at reference numeral 90 through reference numeral 94. If at reference numeral 98 it is determined that a solution is not possible, a fail flag is set at reference numeral 100 and the method ends at reference numeral 82.

If an acceptable solution is possible, the method proceeds to reference numeral 102 where phase delay, switch setting, and radiator length corrections that are necessary for correction are calculated. Next, at reference numeral 104 the determined corrected phase delays and radiator lengths of driven (and/or passive) radiators are sent by the controller to the length control and coupling units 14*a* through 14*n* and the variable phase units 18*a* through 18*n*.

After the commands defined at reference numeral 104 have been executed the method returns to reference numeral 90 where RF energy is again injected into the phased array at the selected operating frequency. The method then re-performs the procedures starting at reference numeral 92 to determine if the performance of the phased antenna array following the latest adjustments is within tolerance.

Figure 6A:
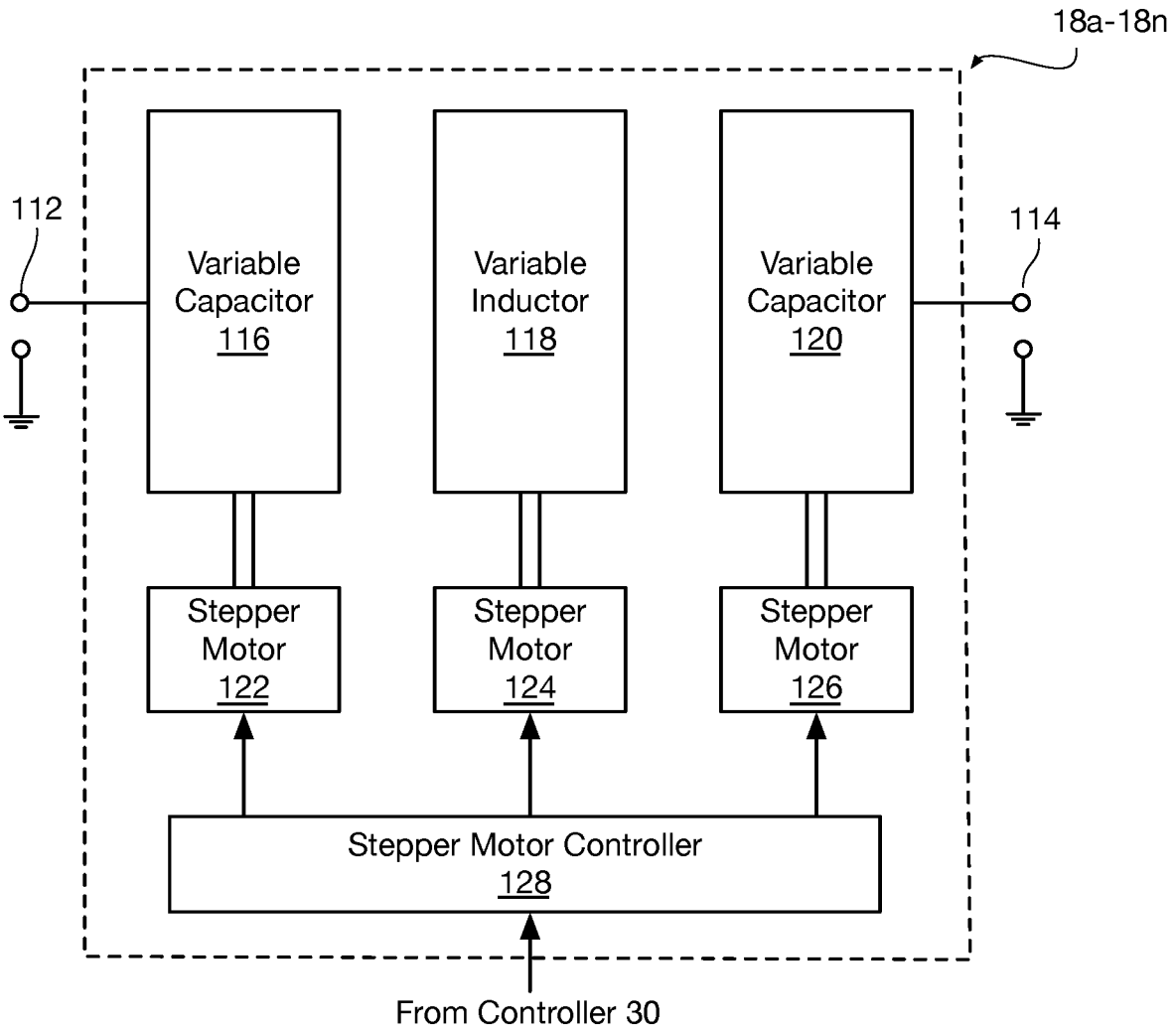
FIG. 6A is a block diagram showing an illustrative adjustable phase delay circuit that is suitable for use in the phased-array antenna system of the present invention.
Figure 6B:
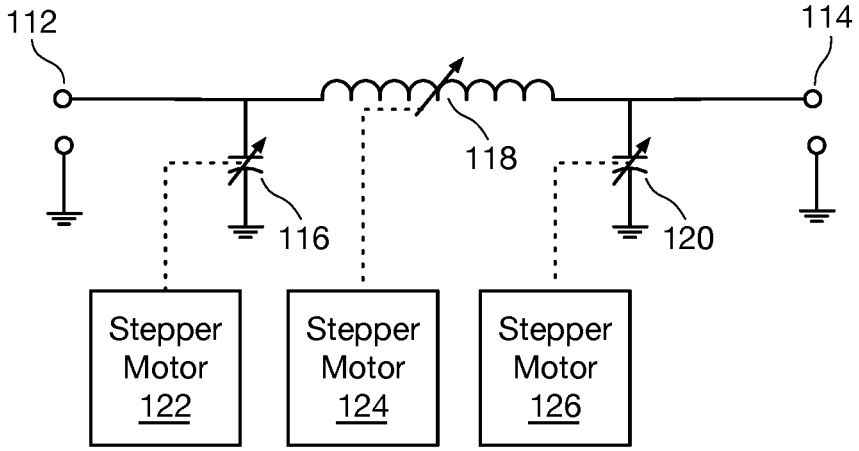
FIG. 6B is a schematic diagram of the adjustable phase delay circuit shown in FIG. 6A.

Referring now to FIG. 6A, a block diagram shows an illustrative adjustable phase delay circuit that is suitable for use in the phased-array antenna system of the present invention. The phase delay circuit (shown in FIGS. 1A and 1B at reference numerals 18*a* through 18*n*) in FIG. 6A is in the form of an adjustable Pi network, a schematic diagram of which is shown in FIG. 6B. Pi networks are well known in the art.

The phase delay circuit 18*a* through 18*n* includes an input node 112, and an output node 114. The input node 112 and the output node 114 are shown as unbalanced but persons of ordinary skill in the art will appreciate that balanced inputs and outputs could be employed. An input variable capacitor 116 is connected across the input node. A variable inductor 118 is connected between the input node 112 and the output node 114. An output variable capacitor 120 is connected across the output node. In illustrative non-limiting embodiments of the invention, the input variable capacitor 116 and the output variable capacitor 120 may be parallel plate air-gap type capacitors and the variable inductor 118 may be an air-gap roller-tap inductor. In any given embodiment, the values of capacitance for the input variable capacitor 116 and the output variable capacitor 120 and the value of inductance for the variable inductor 118 are selected to provide a desired range of phase delay and impedance matching as is known in the art.

As shown in FIG. 6A, the capacitance of the input variable capacitor may be remotely varied by means of a stepper motor 122 connected to the shaft on which the rotating plates are formed. The inductance of the variable inductor 118 may be remotely varied by means of a stepper motor 124 connected to the shaft on which the roller coil tap turns. The capacitance of the output variable capacitor may be remotely varied by means of a stepper motor 126 connected to the shaft on which the rotating plates are formed. A stepper motor controller 128 is coupled to the controller 30 of either FIG. 1A or 1B, which drives the stepper motor controller 128 using feedback from the phase and current sensors 20*a* through 20*n* of FIG. 1A and FIG. 1B.

The use of Pi networks to provide variable phase delays is known and is discussed, for example, in the article P. Anderson, *Phased Verticals with Continuous Phase Control*, Vertical Antenna Classics, ARRL Publication 201 of the Radio Amateur's Library, 1999, ISBN: 0-87259-521-8.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A phased antenna array comprising:

a plurality of variable length radiators arrayed in a geometric pattern;

a length control mechanism mechanically coupled to each one of the variable length radiators and responsive to radiator length control data to control a length of the variable length radiator to which it is coupled;

a transmitter having an output from which to drive radio frequency energy;

a switch coupled between each individual one of the variable length radiators and the transmitter output to configure each variable length radiator as a driven radiator or a passive radiator while radio frequency energy is being driven by the transmitter output;

a variable phase delay circuit coupled to each of the variable length radiators and responsive to phase delay control data to control a phase delay of a radio frequency signal coupled to the variable phase delay circuit to which it is coupled;

a phase sensor and a current sensor each radio frequency coupled to each individual one of the variable length radiators;

a controller configured to implement a desired azimuthal radiation pattern and impedance in the phased antenna array, the controller having an individual output coupled to each of the switches and configured to send switch control data to control the state of each switch to configure each variable length radiator as a passive radiator or as a driven radiator while radio frequency energy is being driven by the transmitter output, the controller having an individual phase delay circuit control output coupled to each one of the variable phase delay circuits and configured to send the phase delay control data to each one of the variable phase delay circuits, the controller further having an individual length control circuit coupled to each one of the length control mechanisms and configured to send the radiator length control data to each one of the length control mechanisms to completely retractor to adjust length of each variable length radiator.

2. The phased antenna array of claim 1 wherein each variable phase delay circuit coupled to each of the variable length radiators comprises a Pi network driven by stepper motors in response to the phase delay control data.

3. The phased antenna array of claim 1 wherein:

the switch control data is communicated to the switches over switch control lines coupled between the controller and each of the switches;

the radiator length control data is communicated to the length control mechanisms over control lines coupled between the controller and each of the length control mechanisms; and the phase delay control data is communicated to the variable phase delay circuits over control lines coupled between the controller and each of the variable phase delay circuits.

4. The phased antenna array of claim 1 wherein:

the switch control data is communicated to the switches over a wireless link coupled between the controller and the switches;

the radiator length control data is communicated to the length control mechanisms over a wireless link coupled between the controller and the length control mechanisms; and the phase delay control data is communicated to the variable phase delay circuits over a wireless link coupled between the controller and the variable phase delay circuits.

5. The phased antenna array of claim 1 wherein:

the phase sensors and the current sensors are configured to send phase and current data to the controller; and the controller is configured to adjust a current and a phase of radio frequency signals on each of the variable length radiators in response to phase and current data communicated from the phase sensors and the current sensors to implement the desired azimuthal radiation pattern and impedance in the phased antenna array.

6. The phased antenna array of claim 1 wherein the controller is configured to use phase and current data communicated from the phase sensors and the current sensors to the controller to adjust the current and phase of radio frequency signals on each of the variable length radiators by adjusting at least one of the length control mechanisms, the switches, and the variable phase delay circuits coupled to each of the variable length radiators.

7. The phased antenna array of claim 1 wherein the phase sensors and the current sensors communicate with the controller over control lines.

8. The phased antenna array of claim 1 wherein the phase sensors and the current sensors communicate with the controller over a wireless link.

9. The phased antenna array of claim 1 wherein the controller is configured to control operation of the phased antenna array using stored sets of switch control data, radiator length control data and phase delay control data for each of the plurality of variable length radiators, the sets of switch control data, radiator length control data and phase delay control data representing a plurality of different azimuthal radiation patterns of the phased array.

10. The phased antenna array of claim 1 wherein the controller is configured to accept manual entry of the switch control data, the radiator length control data and the phase delay control data for each of the plurality of variable length radiators.

11. The phased antenna array of claim 1 further comprising a transmission line coupled between each one of the variable phase delay circuits and at least one of the transmitter and a radio receiver to convey radio frequency signals between each one of the variable phase delay circuits and the at least one of a radio transmitter and a radio receiver.

12. The phased antenna array of claim 11 wherein the transmission line coupled between each one of the variable phase delay circuits and the at least one of the transmitter and the radio receiver is a single transmission line coupled in series between each one of the variable phase delay circuits.

13. The phased antenna array of claim 11 wherein the transmission line coupled between each one of the variable phase delay circuits and at least one of the transmitter and the radio receiver comprises an individual transmission line coupled between each one of the variable phase delay circuits and the at least one of a radio transmitter and a radio receiver.

14. The phased antenna array of claim 1 wherein the transmitter is a transceiver including a receiver.

15. A method for operating a phased antenna array including a plurality of variable length radiators to provide a desired azimuthal radiation pattern of the phased antenna array, the method comprising:

separately controlling a length of each of the variable length radiators in response to radiator length control data from a controller;

separately controlling whether each of the variable length radiators is configured as a driven or passive radiator in response to switch control data from the controller; and separately controlling a relative phase of radio frequency signals coupled between each of the variable length radiators and at least one of a radio transmitter and a radio receiver in response to phase delay control data from the controller.

16. The method of claim 15 wherein the radiator length control data, the switch control data, and the phase delay control data are retrieved from a memory associated with the controller in response to a directional or other azimuthal radiation pattern command received by the controller.

17. The method of claim 15 wherein the radiator length control data, the switch control data, and the phase delay control data are generated by antenna modeling in response to a directional or other azimuthal radiation pattern command received by the controller.

18. A phased antenna array comprising:

a plurality of variable length radiators arrayed in a geometric pattern; a length control mechanism mechanically coupled to each one of the variable length radiators a nd responsive to radiator length control data to control a length of the variable length radiator to which it is coupled; a transmitter having an output from which to drive radio frequency energy;

a variable phase delay circuit coupled to each of the variable length radiators and responsive to phase delay control data to control a phase delay of a radio frequency signal coupled to the variable phase delay circuit to which it is coupled;

a phase sensor and a current sensor each radiofrequency coupled to each individual one of the variable length radiators;

a controller configured to implement a desired azimuthal radiation pattern and impedance in the phased antenna array, the controller having an individual phase delay circuit control output coupled to each one of the variable phase delay circuits and configured to send the phase delay control data to each one of the variable phase delay circuits, the controller further having an individual length control circuit coupled to each one of the length control mechanisms and configured to send the radiator length control data to each one of the length control mechanisms to completely retractor to adjust length of each variable length radiator.

19. The phased antenna array of claim 18 wherein:

the radiator length control data is communicated to the length control mechanisms over control lines coupled between the controller and each of the length control mechanisms; and the phase delay control data is communicated to the variable phase delay circuits over control lines coupled between the controller and each of the variable phase delay circuits.

20. The phased antenna array of claim 18 wherein the controller is configured to accept manual entry of the radiator length control data and the phase delay control data for each of the plurality of variable length radiators.

21. The phased antenna array of claim 18 wherein the controller is configured to control operation of the phased antenna array using one of stored sets of radiator length control data and phase delay control data for each of the plurality of variable length radiators, the sets of radiator length control data and phase delay control data representing a plurality of different azimuthal radiation patterns of the phased array or radiator length control data and phase delay control data generated by antenna modeling in response to a directional or other azimuthal radiation pattern command received by the controller.

* * * * *